US010603719B2

(12) United States Patent
Khabashesku et al.

(10) Patent No.: US 10,603,719 B2
(45) Date of Patent: Mar. 31, 2020

(54) CUTTING ELEMENTS AND METHODS FOR FABRICATING DIAMOND COMPACTS AND CUTTING ELEMENTS WITH FUNCTIONALIZED NANOPARTICLES

(71) Applicant: Baker Hughes, a GE company, LLC, Houston, TX (US)

(72) Inventors: Valery N. Khabashesku, Houston, TX (US); Vladimir P. Filonenko, Moscow (RU)

(73) Assignee: Baker Hughes, A GE Company, LLC, Houston, TX (US)

( * ) Notice: Subject to any disclaimer, the term of this patent is extended or adjusted under 35 U.S.C. 154(b) by 193 days.

(21) Appl. No.: 15/692,323

(22) Filed: Aug. 31, 2017

(65) Prior Publication Data

US 2019/0061004 A1 Feb. 28, 2019

(51) Int. Cl.

| | |
|---|---|
| ***E21B 10/573*** | (2006.01) |
| ***B22F 1/00*** | (2006.01) |
| ***B22F 3/14*** | (2006.01) |
| ***B22F 5/00*** | (2006.01) |
| ***B22F 7/06*** | (2006.01) |
| ***C22C 26/00*** | (2006.01) |

(Continued)

(52) U.S. Cl.

CPC ..... *B22F 7/06* (2013.01); *B22F 1/0003* (2013.01); *B22F 3/14* (2013.01); *B22F 5/00* (2013.01); *C22C 26/00* (2013.01); *C22C 29/08* (2013.01); *E21B 10/5735* (2013.01); *B22F 2005/001* (2013.01); *B22F 2301/052* (2013.01); *B22F 2301/15* (2013.01); *B22F 2302/406* (2013.01); *B22F 2998/10* (2013.01); *E21B 10/55* (2013.01)

(58) Field of Classification Search

CPC ..... E21B 10/567; E21B 10/55; E21B 10/46; B24D 18/0009; B24D 3/06; B24D 99/005; C22C 26/00; C04B 2235/427; C04B 2235/5436; C04B 35/62802; C04B 35/645

See application file for complete search history.

(56) References Cited

U.S. PATENT DOCUMENTS 6,350,191 B1 2/2002 D'Evelyn
7,806,206 B1 10/2010 Miess (Continued)

OTHER PUBLICATIONS

Underwood, Ervin E., Quantitative Stereology, Addison Wesley Publishing Company, Inc., (1970), pp. 80-109.

(Continued)

*Primary Examiner* — Daniel P Stephenson
(74) *Attorney, Agent, or Firm* — TraskBritt

(57) ABSTRACT

A polycrystalline diamond compact (PDC) cutting element includes a substrate and a polycrystalline diamond compact. The substrate comprises a ceramic-metal composite material including hard ceramic particles in a metal matrix. The polycrystalline diamond compact includes interbonded diamond particles. Interstitial material disposed within interstitial spaces between the interbonded diamond particles comprises aluminum and at least one element of the ceramic-metal composite material of the substrate. A method of manufacturing such a PDC cutting element includes forming a mixture including diamond particles and particles of aluminum, and subjecting the mixture and a substrate to a high pressure, high temperature (HPHT) sintering process.

19 Claims, 3 Drawing Sheets

(51) Int. Cl.
*C22C 29/08* (2006.01)
*E21B 10/55* (2006.01)

(56) References Cited

U.S. PATENT DOCUMENTS 7,820,130 B2 10/2010 Khabashesku et al.
8,151,911 B1 * 4/2012 Miess ..... C22C 1/051 175/428
9,254,554 B1 * 2/2016 Bertagnolli ..... B01J 3/062
2008/0023231 A1 * 1/2008 Vail ..... E21B 10/567 175/434
2009/0260895 A1 * 10/2009 Vail ..... B01J 3/062 175/434
2010/0084196 A1 * 4/2010 Bertagnolli ..... C22C 26/00 175/428
2011/0017519 A1 * 1/2011 Bertagnolli ..... B22F 7/08 175/428
2012/0085585 A1 4/2012 Scott et al.
2012/0241226 A1 * 9/2012 Bertagnolli ..... C22C 26/00 175/428
2013/0048389 A1 * 2/2013 Bao ..... B24D 18/0009 175/428
2013/0068541 A1 3/2013 DiGiovanni et al.
2014/0246250 A1 * 9/2014 Khabashesku ..... E21B 10/567 175/428
2015/0008047 A1 1/2015 DiGiovanni
2015/0107163 A1 * 4/2015 Konovalov ..... C04B 35/52 51/298
2016/0251741 A1 9/2016 Kanyanta et al.
2016/0263725 A1 * 9/2016 Miess ..... B24D 3/06
2017/0209984 A1 * 7/2017 Khabashesku ..... E21B 10/46
2019/0061004 A1 * 2/2019 Khabashesku ..... B22F 7/06

OTHER PUBLICATIONS

International Search Report for International Application No. PCT/US2018/048874 dated Jan. 2, 2019, 3 pages.
International Written Opinion for International Application No. PCT/US2018/048874 dated Jan. 2, 2019, 6 pages.

* cited by examiner

CUTTING ELEMENTS AND METHODS FOR FABRICATING DIAMOND COMPACTS AND CUTTING ELEMENTS WITH FUNCTIONALIZED NANOPARTICLES

FIELD

Embodiments of the present disclosure relate generally to methods of forming polycrystalline diamond material, cutting elements and methods of forming cutting elements including polycrystalline diamond material, and green bodies that may be used to form such cutting elements.

BACKGROUND

Earth-boring tools for forming wellbores in subterranean earth formations may include a plurality of cutting elements secured to a body. For example, fixed-cutter earth-boring rotary drill bits (also referred to as "drag bits") include a plurality of cutting elements fixedly attached to a bit body of the drill bit. Similarly, roller cone earth-boring rotary drill bits include cones mounted on bearing pins extending from legs of a bit body such that each cone is capable of rotating about the bearing pin on which the cone is mounted. A plurality of cutting elements may be mounted to each cone of the drill bit.

The cutting elements used in such earth-boring tools often include polycrystalline diamond cutters (often referred to as "PDCs"), which are cutting elements that include a polycrystalline diamond (PCD) material. Such polycrystalline diamond cutting elements are formed by sintering and bonding together relatively small diamond grains or crystals under conditions of high temperature and high pressure in the presence of a catalyst (such as cobalt, iron, nickel, or alloys and mixtures thereof) to form a layer of polycrystalline diamond material on a cutting element substrate. These processes are often referred to as "high pressure, high temperature" (or "HPHT") processes. The cutting element substrate may be a cermet material (i.e., a ceramic-metal composite material) such as cobalt-cemented tungsten carbide. In such instances, the cobalt or other catalyst material (e.g., iron, nickel, or an alloy including cobalt, iron, or nickel) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HPHT process.

Cobalt, which is commonly used in sintering processes to form PCD material, melts at about 1,495° C. The melting temperature may be reduced by alloying cobalt with carbon or another element, so HPHT sintering of cobalt-containing bodies may be performed at temperatures above about 1,450° C.

Upon formation of a diamond table using an HPHT process, catalyst material may remain in interstitial spaces between the grains or crystals of diamond in the resulting polycrystalline diamond table. The presence of the catalyst material in the diamond table may contribute to thermal damage in the diamond table when the cutting element is heated during use, due to friction at the contact point between the cutting element and the formation. Polycrystalline diamond cutting elements in which the catalyst material remains in the diamond table are generally thermally stable up to temperatures of about 750° C., although internal stress within the polycrystalline diamond table may begin to develop at temperatures exceeding about 350° C. This internal stress is at least partially due to differences in the rates of thermal expansion between the diamond table and the cutting element substrate to which it is bonded. This differential in thermal expansion rates may result in relatively large compressive and tensile stresses at the interface between the diamond table and the substrate, and may cause the diamond table to delaminate from the substrate. At temperatures of about 750° C. and above, stresses within the diamond table may increase significantly due to differences in the coefficients of thermal expansion of the diamond material and the catalyst material within the diamond table itself. For example, cobalt thermally expands significantly faster than diamond, which may cause cracks to form and propagate within a diamond table including cobalt, eventually leading to deterioration of the diamond table and ineffectiveness of the cutting element. Furthermore, at temperatures commonly encountered during drilling operations, catalyst material in a diamond table may catalyze diamond transformation back to graphite (which may be referred to in the art as "back-graphitization").

To reduce the problems associated with different rates of thermal expansion and back-graphitization in polycrystalline diamond cutting elements, so-called "thermally stable" polycrystalline diamond (TSD) cutting elements have been developed. Such a thermally stable polycrystalline diamond cutting element may be formed by leaching the catalyst material (e.g., cobalt) out from interstitial spaces between the diamond grains in the diamond table using, for example, an acid. All of the catalyst material may be removed from the diamond table, or only a portion may be removed. Thermally stable polycrystalline diamond cutting elements in which substantially all catalyst material has been leached from the diamond table have been reported to be thermally stable up to temperatures of about 1,200° C. It has also been reported, however, that fully leached diamond tables are relatively more brittle and vulnerable to shear, compressive, and tensile stresses than are non-leached diamond tables. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which only a portion of the catalyst material has been leached from the diamond table.

BRIEF SUMMARY

In accordance with some embodiments of the present disclosure, a polycrystalline diamond compact (PDC) cutting element includes a substrate and a polycrystalline diamond compact disposed on the substrate. The substrate comprises a ceramic-metal composite material including hard ceramic particles in a metal matrix. The metal matrix may comprise at least one of cobalt, iron, and nickel. The polycrystalline diamond compact includes interbonded diamond particles. In particular, the interbonded diamond particles may include a first plurality of diamond particles having an average particle size in a range extending from about three microns (3 μm) to about thirty microns (30 μm) and a second plurality of diamond particles having an average particle size in a range extending from about eighty nanometers (80 nm) to about one hundred nanometers (100 nm). The polycrystalline diamond compact further includes interstitial material disposed within interstitial spaces between the interbonded diamond particles, and the interstitial material may comprise aluminum and at least one element of the ceramic-metal composite material of the substrate.

In accordance with additional embodiments of the present disclosure, an earth-boring tool includes a tool body and one or more such PDC cutting elements attached to the tool body.

In yet further embodiments of the present disclosure, a method of manufacturing a PDC cutting element includes forming a mixture including diamond particles and particles of aluminum, positioning the mixture adjacent a substrate, and subjecting the mixture and the substrate to a high pressure, high temperature (HPHT) sintering process to form a polycrystalline diamond compact on the substrate. In particular, the diamond particles of the mixture may include a first plurality of diamond particles having an average particle size in a range extending from about three microns (3 μm) to about thirty microns (30 μm) and a second plurality of diamond particles having an average particle size in a range extending from about eighty nanometers (80 nm) to about one hundred nanometers (100 nm). The first plurality of diamond particles may constitute between about fifty weight percent (50 wt %) and about ninety weight percent (90 wt %) of the mixture, the second plurality of diamond particles may constitute between about ten weight percent (10 wt %) and about fifty weight percent (50 wt %) of the mixture, and the aluminum particles may constitute between about one weight percent (1 wt %) and about five weight percent (5.0 wt %) of the mixture.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
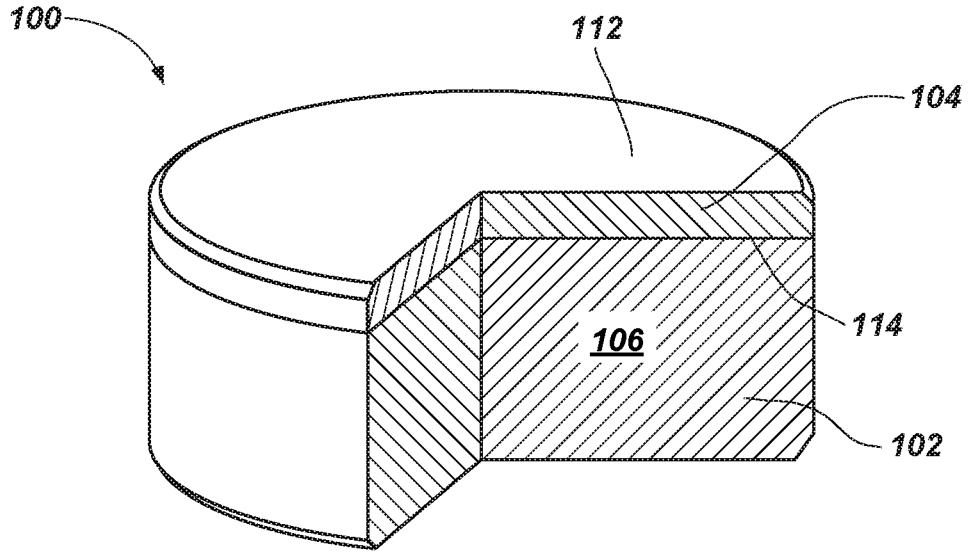
FIG. 1 is a partially cut-away perspective view of a PDC cutting element of the present disclosure.

The illustrations presented herein are not meant to be actual views of any particular material, apparatus, system, or method, but are merely idealized representations employed to describe certain embodiments. For clarity in description, various features and elements common among the embodiments may be referenced with the same or similar reference numerals.

As used herein, the term "earth-boring tool" means and includes any type of drill bit or other tool used for drilling during the formation or enlargement of a wellbore and includes, for example, rotary drill bits, percussion bits, core bits, eccentric bits, bicenter bits, reamers, expandable reamers, mills, drag bits, roller cone bits, hybrid bits, and other drilling bits and tools known in the art.

The term "polycrystalline material" means and includes any material comprising a plurality of grains (i.e., crystals) of the material that are bonded directly together by inter-granular bonds. The crystal structures of the individual grains of the material may be randomly oriented in space within the polycrystalline material.

As used herein, the term "inter-granular bond" means and includes any direct atomic bond (e.g., ionic, covalent, metallic, etc.) between atoms in adjacent grains of material.

As used herein, the term "grain size" means and includes a geometric mean diameter measured from a two-dimensional section through a bulk material. The geometric mean diameter for a group of particles may be determined using techniques known in the art, such as those set forth in Ervin E. Underwood, Quantitative Stereology, 103-105 (Addison-Wesley Publishing Company, Inc., 1970), which is incorporated herein in its entirety by this reference.

FIG. 1 illustrates polycrystalline diamond compact (PDC) cutting element 100 of the present disclosure, which may be employed in conjunction with earth-boring tools. The PDC cutting element includes a substrate 102, and a polycrystalline diamond compact 104 disposed on the substrate 102. As discussed in further detail below, the PDC cutting element 100 may be an unleached, thermally stable PDC cutting element 100. In other words, although the PDC cutting element 100 is not leached, it exhibits thermal stability similar to commercially available PDC cutting elements that have been leached, and even similar to commercially available PDC cutting elements that have been leached to a depth of one hundred microns or more. The PDC cutting elements 100 of the present disclosure may retain their properties when heated in an inert atmosphere to 1200° C. Furthermore, the PDC cutting elements 100 may exhibit abrasion resistance substantially equal to, and in some instances, greater than abrasion resistance exhibited by commercially available PDC cutting elements that have been leached.

The substrate 102 may be a standard substrate of the type commonly employed in the industry. For example, the substrate 102 may comprise a ceramic-metal composite material 106 including hard ceramic particles cemented together by a metal matrix. In such embodiments, the metal matrix may comprise at least one of cobalt, iron, and nickel. As a non-limiting example, the substrate 102 may comprise tungsten carbide particles disposed in a metal (elemental or an alloy) matrix comprising or consisting of cobalt. In such embodiments, the ceramic-metal composite material 106 may be characterized as a "cobalt-cemented tungsten carbide composite material." The metal matrix (e.g., cobalt) may constitute between about two weight percent (2 wt %) and about ten weight percent (10 wt %) of the substrate 102, with the hard particles (e.g., tungsten carbide particles) constituting the remainder of the substrate 102.

In some embodiments, the polycrystalline diamond compact 104 may be generally cylindrical, and may have a diameter of, for example, from three millimeters (3 mm) to twenty-five millimeters (25 mm). The polycrystalline diamond compact 104 may have a thickness of, for example, from about one millimeter (1 mm) to about three millimeters (3 mm). PDC cutting elements of other shapes are known, however, and additional embodiments of the present disclosure include non-cylindrical shaped cutting elements in which a non-planar polycrystalline diamond compact, but otherwise composed as described herein in relation to the polycrystalline diamond compact 104, is disposed on a substrate.

The polycrystalline diamond compact 104 includes interbonded diamond particles (or grains) 108. In other words, diamond-to-diamond inter-granular bonds are present between the diamond particles 108 in the polycrystalline diamond compact 104.

The interbonded diamond particles may have a multi-modal particle size distribution. For example, the interbonded diamond particles may include a first plurality of relatively larger diamond particles 108A and a second plurality of relatively smaller diamond particles 108B. As non-limiting examples, the first plurality of diamond particles 108A may have an average particle size in a range extending from about three microns (3 μm) to about thirty microns (30 μm), more particularly from about six microns (6 μm) to about twenty microns (20 μm), or even more particularly from about eight microns (8 μm) to about twelve microns (12 μm). The second plurality of diamond particles 108B may comprise diamond nanoparticles, and may have an average particle size in a range extending from about fifty nanometers (50 nm) to about one hundred fifty nanometers (150 nm), or more particularly from about eighty nanometers (80 nm) to about one hundred nanometers (100 nm).

By employing diamond particles having a multi-modal particle size distribution as described herein, the overall diamond density in the polycrystalline diamond compact 104 may be increased.

The polycrystalline diamond compact 104 may be an unleached polycrystalline diamond compact 104, and may not include any voids (i.e., spaces filled with air or gas) between the interbonded diamond particles 108. On the contrary, the polycrystalline diamond compact 104 includes interstitial material 110 disposed within interstitial spaces between the interbonded diamond particles 108. The interstitial material 110 may comprise aluminum and at least one element of the ceramic-metal composite material 106 of the substrate 102. For example, in embodiments in which the substrate 102 comprises a cobalt-cemented tungsten carbide composite material, the interstitial material may include aluminum, cobalt, and tungsten. The interstitial material may further include other elements, such as oxygen, fluorine, carbon, etc.

Furthermore, as discussed in further detail herein below, an atomic concentration of the aluminum in the polycrystalline diamond compact 104 decreases from an exposed working surface 112 of the polycrystalline diamond compact 104 in a direction extending toward an interface 114 between the polycrystalline diamond compact 104 and the substrate 102. Additionally, an atomic concentration of cobalt in the polycrystalline diamond compact 104 increases from the exposed working surface 112 of the polycrystalline diamond compact 104 in the direction extending toward the interface 114 between the polycrystalline diamond compact 104 and the substrate 102.

As previously discussed herein, cobalt, iron, and nickel are catalysts for the formation of a volume of polycrystalline diamond from diamond particles. These catalysts contribute to or "catalyze" the formation of inter-granular diamond-to-diamond bonds under HPHT sintering conditions (e.g., generally a pressure greater than 5.0 GPa and a temperature higher than 1200° C.). At atmospheric pressures and pressures to which PDC cutting elements are subjected during use (which are substantially greater than 5.0 GPa), however, these metal-solvent catalysts can actually contribute to the conversion of some of the diamond to graphite, which is not desirable. Furthermore, as the PDC cutting element is heated during use, thermal expansion of the catalyst can lead to cracking and formation of other defects in the polycrystalline diamond material. The presence of the metal catalyst in the interstitial spaces between the diamond particles, however, increases the toughness of the polycrystalline diamond. As a result, it is generally considered to be desirable to have a leached region free of the metal catalyst near the working surface 112 of the polycrystalline diamond compact 104, while leaving the metal catalyst in the interstitial spaces between the diamond particles in the remainder of the polycrystalline diamond compact 104.

The methods disclosed herein below allow the formation of the polycrystalline diamond compact 104 on the substrate 102 in a single HPHT sintering cycle in such a manner as to result in the polycrystalline diamond compact 104 including a first region adjacent the working surface 112 of the polycrystalline diamond compact 104 that has a first relatively lower concentration of metal catalyst(s) (i.e., cobalt, iron, and/or nickel) therein, and a second region adjacent the interface 114 between the substrate 102 and the polycrystalline diamond compact 104 that has a second relatively higher concentration of metal catalyst(s) (i.e., cobalt, iron, and/or nickel) therein. As a result, the PDC cutting elements 100 as described herein may exhibit thermal stability and abrasion resistance similar to, and in some cases better than commercially available PDC cutting elements that have been leached.

Figure 3:
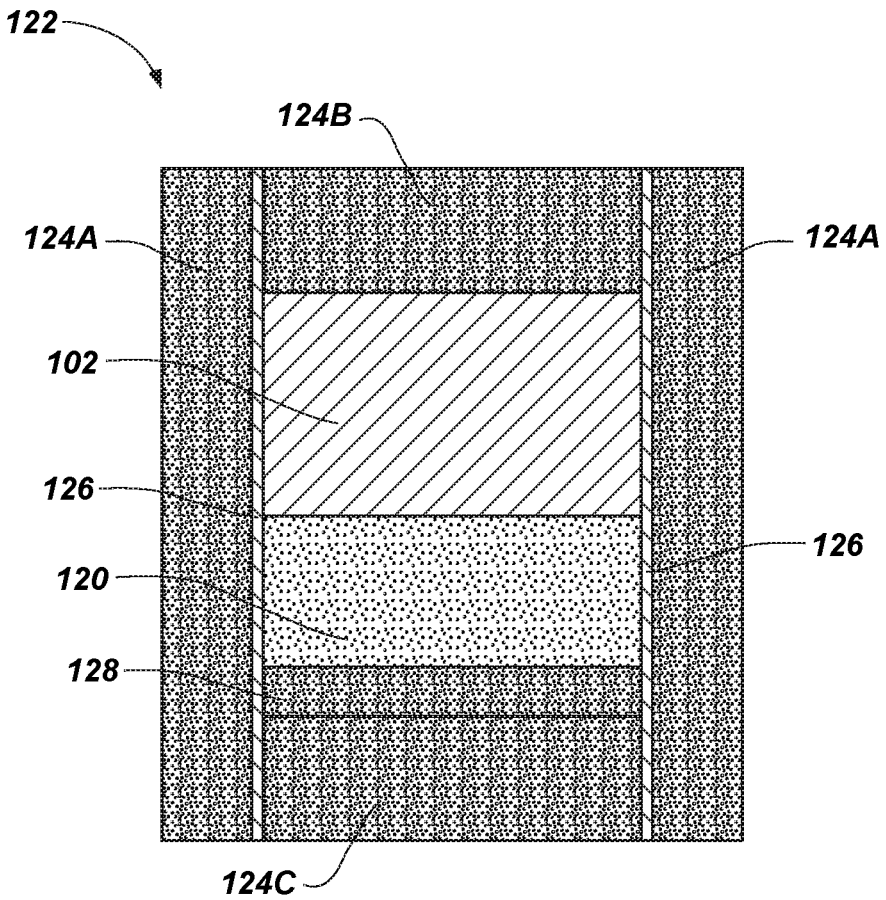
FIG. 3 is a simplified cross-sectional side view illustrating a substrate and a powder mixture including diamond particles in an assembly to be subjected to an HPHT sintering process to form a PDC cutting element like that shown in FIG. 1.

A method of forming a PDC cutting element 100 is described below with reference to FIG. 3. A mixture 120 may be formed and provided within an assembly 122 to be subjected to an HPHT sintering cycle. As shown in FIG. 3, the mixture 120 may be positioned adjacent a substrate 102 within the assembly 122. The substrate 102 may be as previously discussed, and may be separately formed using conventional sintering processes prior to positioning the substrate 102 within the assembly 122.

Figure 2:
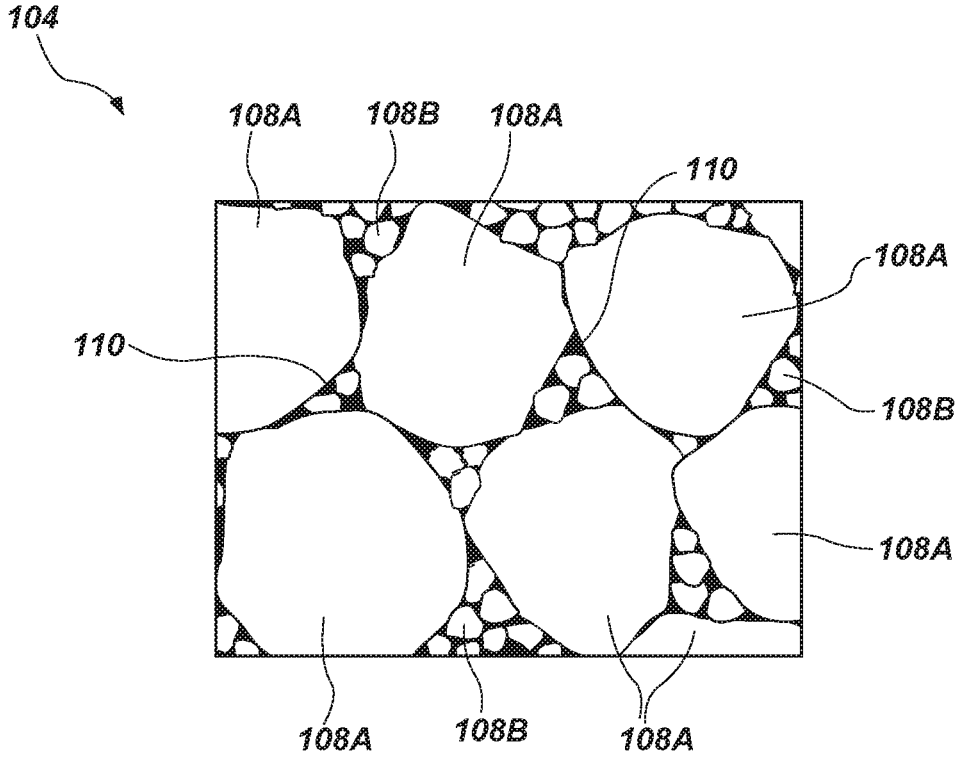
FIG. 2 is a simplified drawing illustrating a microstructure of a polycrystalline diamond compact of the cutting element of FIG. 1.

The mixture 120 includes a first plurality of relatively larger diamond particles (which will ultimately form the larger diamond particles 108A of FIG. 2), a second plurality of relatively smaller diamond particles (which will ultimately form the smaller diamond particles 108B of FIG. 2), and particles of aluminum. The aluminum will ultimately be disposed in the interstitial material 110 (FIG. 2) between the inter-bonded diamond grains of the polycrystalline diamond compact 104.

The first plurality of relatively larger diamond particles may have an average particle size in a range extending from about three microns (3 μm) to about thirty microns (30 μm), more particularly from about six microns (6 μm) to about twenty microns (20 μm), or even more particularly from about eight microns (8 μm) to about twelve microns (12 μm). The second plurality of relatively smaller diamond particles may comprise crushed diamond nanoparticles, which are known to include less non-diamond carbon than diamond nanoparticles formed by methods other than crushing. For example, the second plurality of relatively smaller diamond particles may have an average particle size in a range extending from about fifty nanometers (50 nm) to about one hundred fifty nanometers (150 nm), or more particularly from about eighty nanometers (80 nm) to about one hundred nanometers (100 nm).

The aluminum particles in the mixture may have an average particle size in a range extending from about one tenth of one micron (0.1 μm) to about one micron (1.0 μm), and more particularly between about seven tenths of one micron (0.7 μm) and about nine tenths of one micron (0.7 μm) (e.g., about 0.8 μm).

The first plurality of diamond particles may constitute between about fifty weight percent (50 wt %) and about ninety weight percent (90 wt %) of the mixture 120, the second plurality of diamond particles may constitute between about ten weight percent (10 wt %) and about fifty weight percent (50 wt %) of the mixture 120, and the aluminum may constitute between about one weight percent (1 wt %) and about fifteen weight percent (15 wt %) of the mixture 120. More particularly, the aluminum may constitute between about two weight percent (2 wt %) and about five weight percent (5 wt %) of the mixture 120 (e.g., about three weight percent (3 wt %).

As one particular non-limiting example embodiment, the first plurality of diamond particles may constitute about seventy weight percent (68 wt %) of the mixture 120, the second plurality of diamond particles may constitute about twenty-nine weight percent (29 wt %) of the mixture 120, and the aluminum may constitute about three weight percent (3.0 wt %) of the mixture 120. In this non-limiting example embodiment, the first plurality of diamond particles may have particle diameters ranging from eight microns (8 μm) to twelve microns (12 μm), the second plurality of diamond particles may have particle diameters ranging from eighty nanometers (80 nm) to one hundred nanometers (100 nm), and the aluminum particles may have an average particle size of about eight tenths of a micron (0.8 μm).

In some embodiments, the diamond particles of the first and/or second pluralities may be functionalized so as to include fluorine atoms bonded to the surfaces of the diamond particles, as described in U.S. patent application Ser. No. 15/005,212, which was filed Jan. 25, 2016, the disclosure of which is incorporated herein in its entirety by this reference.

With continued reference to FIG. 3, the assembly 122 further includes one or more electrically and thermally conductive components 124A-124C, which encapsulate the mixture 120 and the substrate 102 therein. By way of example and not limitation, the components 124A-124C may comprise graphite. It is desirable, however, to isolate the mixture 120, which includes diamond particles, from the graphite of the components 124A-124C, as carbon from the graphite could lead to growth of diamond particles. Thus, a foil 126 may be provided around the mixture 120 and the substrate 102, such that the foil 126 is disposed between and separates the lateral side surfaces of the mixture 120 and the substrate 102 from the graphite component 124A. The foil 126 comprises a layer of material that will act as a diffusion barrier during the sintering process, such as a layer of tantalum, for example. Another layer 128 may be disposed between the mixture 120 and the graphite component 124C. The another layer 128 may comprise a material that is electrically and thermally insulating, such as a composite material comprising graphite and boron nitride.

With continued reference to FIG. 3, the assembly 122 (and the mixture 120 and substrate 102 disposed therein) then may be subjected to an HPHT sintering process to form the polycrystalline diamond compact 104, as previously described herein, on the substrate 102. The HPHT process may involve subjecting the mixture 120 and the substrate 102 to a pressure greater than about 5.0 GPa and a temperature higher than about 1,450° C. In some embodiments, the HPHT process may involve subjecting the mixture 120 and the substrate 102 to a pressure in a range extending from about 7.5 GPa to about 8.0 GPa, and a temperature in a range extending from about 1,550° C. to about 1,650° C. During the HPHT process, the temperature of the mixture 120 and the substrate 102 may be increased at a rate of about 50° C./s until the sintering temperature is reached. Upon reaching the sintering temperature, the temperature may be held for about 60 seconds.

During the sintering process under these parameters, the aluminum is liquefied, as is the metal of the metal matrix of the substrate 102, which may be cobalt (a known catalyst for the formation of diamond-to-diamond bonds), for example. The molten metal of the metal matrix of the substrate 102 is swept into what was the mixture 120, and particularly between the diamond particles therein. Thus, the cobalt mixes with the aluminum and other elements present within the spaces between the diamond particles. Some tungsten may also diffuse from the substrate 102 into the mixture 120 during the sintering process.

By employing the larger sized diamond particles together with the smaller sized diamond particles, and by increasing the pressure during the HPHT cycle, the diamond density can be increased and the pore spaces between the diamond particles can be decreased, which may lead to a decreased rate of diffusion of the cobalt or other metal catalyst from the substrate 102 through the mixture. As the cobalt mixes with the aluminum, some of the cobalt and aluminum combine to form an intermetallic compound of cobalt and aluminum (e.g., AlCo), which may have a positive effect on the thermal stability of the resulting polycrystalline diamond compact 104. Furthermore, it is believed that fluorine repels cobalt. Thus, in embodiments in which the diamond particles are fluorinated diamond particles, the sweep of the cobalt into the mixture 120 may be hindered somewhat by the presence of fluorine in the spaces between the diamond particles.

Upon completion of the HPHT sintering process, the formed PDC cutting element 100 may be removed from the HPHT sintering press, and the various other components of the assembly 122 may be removed from the PDC cutting element 100.

Figure 4:
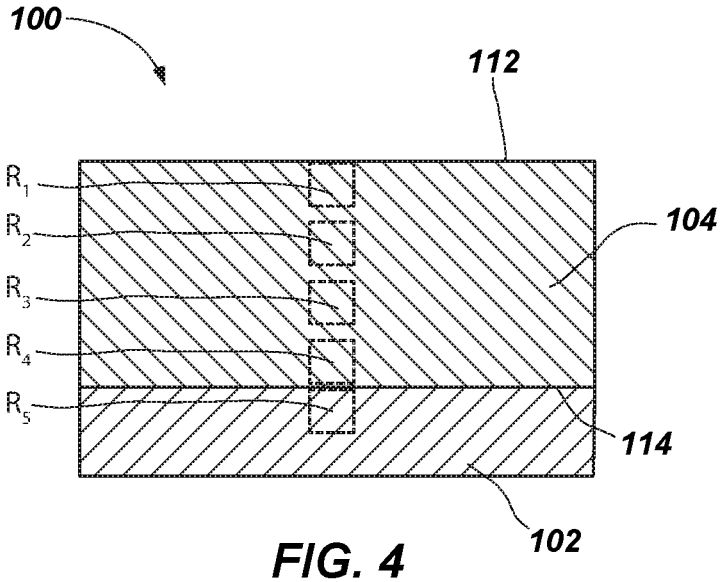
FIG. 4 is an enlarged cross-sectional view of a portion of the cutting element of FIG. 1 illustrating a portion of the polycrystalline diamond compact and a portion of a substrate of the cutting element of FIG. 1.

Referring to FIG. 4, a PDC cutting element 100 was fabricated as described hereinabove and sectioned longitudinally, and the elemental composition was measured in five (5) different regions $R_1$ through $R_5$ within the PDC cutting element 100. In particular, the elemental composition was measured in a first region $R_1$ within the polycrystalline diamond compact 104 adjacent the exposed front working surface 112 of the cutting element 100, the elemental composition was measured in a second region $R_2$ at a second greater depth within the polycrystalline diamond compact 104, the elemental composition was measured in a third region $R_3$ at a third greater depth within the polycrystalline diamond compact 104, and the elemental composition was measured in a fourth region $R_4$ at a fourth greater depth within the polycrystalline diamond compact 104 and adjacent the interface 114 between the polycrystalline diamond compact 104 and the substrate 102. The elemental composition was also measured in a fifth region $R_5$ within the substrate 102 and adjacent the interface 114 between the polycrystalline diamond compact 104 and the substrate 102. The measured elemental composition as measured within each of the five regions $R_1$-$R_5$ is set forth in TABLE 1 below.

TABLE 1

| Region | C | O | Al | Co | W |
|---|---|---|---|---|---|
| | Atomic % | | | | |
| $R_1$ | 95.77 | 3.02 | 0.69 | 0.45 | 0.06 |
| $R_2$ | 96.25 | 2.49 | 0.47 | 0.69 | 0.10 |

TABLE 1-continued

| Region | C | O | Al | Co | W |
|---|---|---|---|---|---|
| | | | Atomic % | | |
| $R_3$ | 96.17 | 2.47 | 0.25 | 0.97 | 0.14 |
| $R_4$ | 96.60 | 2.01 | 0.20 | 0.98 | 0.22 |
| $R_5$ | 51.54 | 1.64 | 0.00 | 3.08 | 43.73 |

As can be seen from the measured elemental compositions in the various regions $R_1$-$R_4$ within the polycrystalline diamond compact 104, aluminum may constitute between about one-tenth of one atomic percent (0.1 at %) and about one atomic percent (1.0 at %) of the polycrystalline diamond compact 104, and more particularly between about two-tenths of one atomic percent (0.2 at %) and about seven-tenths of one atomic percent (0.7 at %) of the polycrystalline diamond compact 104. As can also be seen from TABLE 1, the atomic ratio of aluminum to cobalt at the interface 114 (within Region $R_4$) is about 1:5, while the atomic ratio of aluminum to cobalt at the working surface 112 (within Region $R_1$) is approximately 2:1.

Cobalt forms the stable intermetallic compound with aluminum CoAl with no clear stoichiometry, which may have a positive effect on the thermal stability of the polycrystalline diamond compact 104. In accordance with some embodiments of the present disclosure, the atomic ratio of aluminum to cobalt in the polycrystalline diamond compact 104 may be between 1:1 and 3:1 in a region $R_1$ of the polycrystalline diamond compact 104 adjacent the exposed working surface 112 of the polycrystalline diamond compact 104, and the atomic ratio of aluminum to cobalt in the polycrystalline diamond compact 104 may be between 1:4 and 1:6 in a region $R_4$ of the polycrystalline diamond compact 104 adjacent the interface 114 between the polycrystalline diamond compact 104 and the substrate 102.

During the infiltration of cobalt into the diamond particles from the substrate 102 during the HPHT sintering process, the cobalt dissolves at least part of the aluminum, and reacts with at least some of the aluminum to form thermally stable intermetallic compound(s). Furthermore, the presence of cobalt in the polycrystalline diamond compact 104, and particularly the relatively higher concentrations in regions $R_2$-$R_4$, may serve to increase the toughness and/or fracture resistance of the polycrystalline diamond compact 104 at least in the regions within the polycrystalline diamond compact 104 that are not adjacent the working surface 112.

PDC cutting elements 100 were fabricated as described herein (and without leaching), and were subjected to granite turning tests to measure the abrasion resistance exhibited by the polycrystalline diamond compact 104 relative to the abrasion resistance of commercially available PDC cutting elements that include a leached region extending a depth of about 100 microns into the polycrystalline diamond compact from the outer working surface thereof. The unleached PDC cutting elements 100 of the present disclosure exhibited wear resistance better than that exhibited by the commercially available leached PDC cutting element. Thus, embodiments of the present disclosure may be used to provide PDC cutting elements 100 that exhibit thermal stability and abrasion resistance equal to or better than commercially available leached PDC cutting elements, and without the need for subjecting the PDC cutting elements to a leaching process, which results in reduced manufacturing costs.

Figure 5:
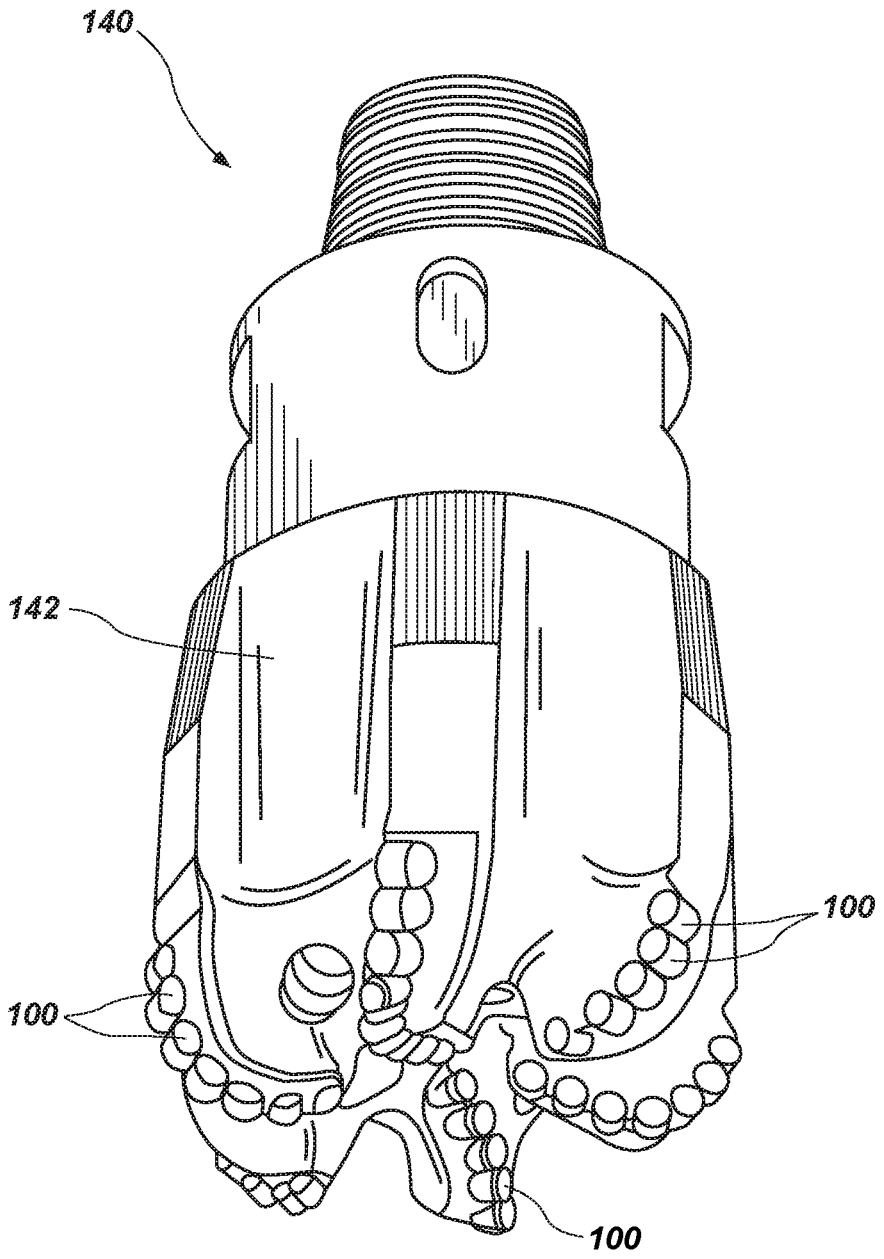
FIG. 5 illustrates an embodiment of an earth-boring tool that includes a plurality of polycrystalline diamond compact cutting elements like that shown in FIG. 1 attached to a body of the tool.

FIG. 5 illustrates an earth-boring tool 140 that includes a plurality of PDC cutting elements 100 as described herein attached to a body 142 of the tool 140. The tool 140 of FIG. 5 is a fixed-cutter rotary drill bit, and the body 142 is the bit body of the drill bit. A plurality of PDC cutting elements 100 as described herein may be mounted on the bit body 142 of the drill bit 140. The PDC cutting elements 100 may be brazed or otherwise secured within pockets formed in the outer surface of the bit body 142. Any other type of earth-boring tool, such as roller-cone bits, percussion bits, hybrid bits, reamers, etc., also may include PDC cutting elements 100 as described herein in additional embodiments of the present disclosure.

Additional non-limiting example embodiments of the disclosure are described below.

Embodiment 1: A polycrystalline diamond compact (PDC) cutting element, comprising: a substrate comprising a ceramic-metal composite material including hard ceramic particles in a metal matrix, the metal matrix comprising at least one of cobalt, iron, and nickel; a polycrystalline diamond compact disposed on the substrate, the polycrystalline diamond compact including interbonded diamond particles, the interbonded diamond particles including a first plurality of diamond particles having an average particle size in a range extending from about three microns (3 μm) to about thirty microns (30 μm) and a second plurality of diamond particles having an average particle size in a range extending from about eighty nanometers (80 nm) to about one hundred nanometers (100 nm), and interstitial material disposed within interstitial spaces between the interbonded diamond particles, the interstitial material comprising aluminum and at least one element of the ceramic-metal composite material of the substrate.

Embodiment 2: The PDC cutting element of Embodiment 1, wherein an atomic concentration of the aluminum in the polycrystalline diamond compact decreases from an exposed working surface of the polycrystalline diamond compact in a direction extending toward an interface between the polycrystalline diamond compact and the substrate.

Embodiment 3: The PDC cutting element of Embodiment 2, wherein aluminum constitutes between about one-half of one atomic percent (0.5 at %) and about four-fifths of one atomic percent (0.8 at %) of the polycrystalline diamond compact in a region of the polycrystalline diamond compact adjacent the exposed working surface of the polycrystalline diamond compact, and aluminum constitutes between about one-tenth of one atomic percent (0.1 at %) and about three-tenths of one atomic percent (0.3 at %) of the polycrystalline diamond compact in a region of the polycrystalline diamond compact adjacent the interface between the polycrystalline diamond compact and the substrate.

Embodiment 4: The PDC cutting element of Embodiment 2 or Embodiment 3, wherein the hard particles of the ceramic-metal composite material of the substrate comprise tungsten carbide particles, and the metal matrix of the ceramic-metal composite material of the substrate comprises cobalt, and wherein the at least one element of the ceramic-metal composite material of the substrate that is disposed in the interstitial spaces between the interbonded diamond particles comprises cobalt.

Embodiment 5: The PDC cutting element of any one of Embodiments 2 through 4, wherein the atomic ratio of aluminum to cobalt in the polycrystalline diamond compact is between 1:1 and 3:1 in a region of the polycrystalline diamond compact adjacent the exposed working surface of the polycrystalline diamond compact, and the atomic ratio of aluminum to cobalt in the polycrystalline diamond compact is between 1:4 and 1:6 in a region of the polycrystalline diamond compact adjacent the interface between the polycrystalline diamond compact and the substrate.

Embodiment 6: The PDC cutting element of any one of Embodiments 1 through 5, wherein aluminum constitutes between about one-tenth of one atomic percent (0.1 at %) and about one atomic percent (1.0 at %) of the polycrystalline diamond compact.

Embodiment 7: The PDC cutting element of any one of Embodiments 1 through 6, wherein the interstitial material comprises an intermetallic compound.

Embodiment 8: The PDC cutting element of Embodiment 7, wherein the intermetallic compound comprises cobalt and aluminum.

Embodiment 9: The PDC cutting element of any one of Embodiments 1 through 8, wherein the polycrystalline diamond compact does not include any voids between the interbonded diamond particles.

Embodiment 10: The PDC cutting element of any one of Embodiments 1 through 9, wherein the interstitial material of the polycrystalline diamond compact constitutes between about one weight percent (1 wt %) and about five weight percent (5 wt %) of the polycrystalline diamond compact.

Embodiment 11: The PDC cutting element of Embodiment 10, wherein the first plurality of diamond particles constitutes between about fifty weight percent (50 wt %) and about ninety weight percent (90 wt %) of the polycrystalline diamond compact.

Embodiment 12: The PDC cutting element of Embodiment 11, wherein the first plurality of diamond particles constitutes between about sixty weight percent (60 wt %) and about eighty weight percent (80 wt %) of the polycrystalline diamond compact.

Embodiment 13: The PDC cutting element of Embodiment 12, wherein the first plurality of diamond particles constitutes about seventy weight percent (70 wt %) of the polycrystalline diamond compact.

Embodiment 14: An earth-boring tool, comprising: a tool body; and a PDC cutting element as recited in any one of Embodiments 1 through 13 attached to the tool body.

Embodiment 15: A method of manufacturing a PDC cutting element, comprising: forming a mixture, including: a first plurality of diamond particles having an average particle size in a range extending from about three microns (3 μm) to about thirty microns (30 μm); a second plurality of diamond particles having an average particle size in a range extending from about eighty nanometers (80 nm) to about one hundred nanometers (100 nm); and particles of aluminum; wherein the first plurality of diamond particles constitutes between about fifty weight percent (50 wt %) and about ninety weight percent (90 wt %) of the mixture, the second plurality of diamond particles constitutes between about ten weight percent (10 wt %) and about fifty weight percent (50 wt %) of the mixture, and the aluminum constitutes between about one weight percent (1 wt %) and about five weight percent (5.0 wt %) of the mixture; positioning the mixture adjacent a substrate; and subjecting the mixture and the substrate to a high pressure, high temperature (HPHT) sintering process to form a polycrystalline diamond compact on the substrate.

Embodiment 16: The method of Embodiment 15, wherein subjecting the mixture and the substrate to an HPHT sintering process comprises subjecting the mixture and the substrate to a pressure of between about 7.5 GPa and about 8.0 GPA, and subjecting the mixture and the substrate to a temperature of between 1550° C. and about 1650° C.

Embodiment 17: The method of Embodiment 15 or Embodiment 16, wherein the first plurality of diamond particles and the second plurality of diamond particles comprise fluorinated diamond particles.

Embodiment 18: The method of any one of Embodiments 15 through 17, further comprising forming an intermetallic compound in interstitial spaces between the first plurality of diamond particles and the second plurality of diamond particles.

Embodiment 19: The method of Embodiment 18, wherein the intermetallic compound comprises cobalt and aluminum.

Embodiment 20: The method of any one of Embodiments 15 through 19, wherein the method does not comprise leaching the polycrystalline diamond compact so as to form voids in interstitial spaces between the first plurality of diamond particles and the second plurality of diamond particles.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various tool types and configurations.

What is claimed is:

1. A polycrystalline diamond compact (PDC) cutting element, comprising:

a substrate comprising a ceramic-metal composite material including hard ceramic particles in a metal matrix, the metal matrix comprising at least one of cobalt, iron, and nickel; and a polycrystalline diamond compact disposed on the substrate, the polycrystalline diamond compact including interbonded diamond particles, the interbonded diamond particles including a first plurality of diamond particles having an average particle size in a range extending from about three microns (3 μm) to about thirty microns (30 μm) and a second plurality of diamond particles having an average particle size in a range extending from about eighty nanometers (80 nm) to about one hundred nanometers (100 nm), and interstitial material disposed within interstitial spaces between the interbonded diamond particles, the interstitial material comprising aluminum and at least one element of the ceramic-metal composite material of the substrate; and wherein an atomic concentration of the aluminum in the polycrystalline diamond compact decreases from an exposed working surface of the polycrystalline diamond compact in a direction extending toward an interface between the polycrystalline diamond compact and the substrate.

2. The PDC cutting element of claim 1, wherein aluminum constitutes between about one-half of one atomic percent (0.5 at %) and about four-fifths of one atomic percent (0.8 at %) of the polycrystalline diamond compact in a region of the polycrystalline diamond compact adjacent the exposed working surface of the polycrystalline diamond compact, and aluminum constitutes between about one-tenth of one atomic percent (0.1 at %) and about three-tenths of one atomic percent (0.3 at %) of the polycrystalline diamond compact in a region of the polycrystalline diamond compact adjacent the interface between the polycrystalline diamond compact and the substrate.

3. The PDC cutting element of claim 1, wherein the hard ceramic particles of the ceramic-metal composite material of the substrate comprise tungsten carbide particles, and the metal matrix of the ceramic-metal composite material of the substrate comprises cobalt, and wherein the at least one element of the ceramic-metal composite material of the substrate that is disposed in the interstitial spaces between the interbonded diamond particles comprises cobalt.

4. The PDC cutting element of claim 1, wherein the atomic ratio of aluminum to cobalt in the polycrystalline diamond compact is between 1:1 and 3:1 in a region of the polycrystalline diamond compact adjacent the exposed working surface of the polycrystalline diamond compact, and the atomic ratio of aluminum to cobalt in the polycrystalline diamond compact is between 1:4 and 1:6 in a region of the polycrystalline diamond compact adjacent the interface between the polycrystalline diamond compact and the substrate.

5. The PDC cutting element of claim 1, wherein the interstitial material comprises an intermetallic compound.

6. The PDC cutting element of claim 5, wherein the intermetallic compound comprises cobalt and aluminum.

7. The PDC cutting element of claim 1, wherein the polycrystalline diamond compact does not include any voids between the interbonded diamond particles.

8. The PDC cutting element of claim 1, wherein the interstitial material of the polycrystalline diamond compact constitutes between about one weight percent (1 wt %) and about five weight percent (5 wt %) of the polycrystalline diamond compact.

9. The PDC cutting element of claim 8, wherein the first plurality of diamond particles constitutes between about fifty weight percent (50 wt %) and about ninety weight percent (90 wt %) of the polycrystalline diamond compact.

10. The PDC cutting element of claim 9, wherein the first plurality of diamond particles constitutes between about sixty weight percent (60 wt %) and about eighty weight percent (80 wt %) of the polycrystalline diamond compact.

11. The PDC cutting element of claim 10, wherein the first plurality of diamond particles constitutes about seventy weight percent (70 wt %) of the polycrystalline diamond compact.

12. An earth-boring tool, comprising:

a tool body; and a PDC cutting element as recited in claim 1 attached to the tool body.

13. A polycrystalline diamond compact (PDC) cutting element, comprising:

a substrate comprising a ceramic-metal composite material including hard ceramic particles in a metal matrix, the metal matrix comprising at least one of cobalt, iron, and nickel; and a polycrystalline diamond compact disposed on the substrate, the polycrystalline diamond compact including interbonded diamond particles, the interbonded diamond particles including a first plurality of diamond particles having an average particle size in a range extending from about three microns (3 μm) to about thirty microns (30 μm) and a second plurality of diamond particles having an average particle size in a range extending from about eighty nanometers (80 nm) to about one hundred nanometers (100 nm), and interstitial material disposed within interstitial spaces between the interbonded diamond particles, the interstitial material comprising aluminum and at least one element of the ceramic-metal composite material of the substrate; and wherein aluminum constitutes between about one-tenth of one atomic percent (0.1 at %) and about one atomic percent (1.0 at %) of the polycrystalline diamond compact.

14. A method of manufacturing a PDC cutting element, comprising: forming a mixture, including:

a first plurality of diamond particles having an average particle size in a range extending from about three microns (3 μm) to about thirty microns (30 μm);

a second plurality of diamond particles having an average particle size in a range extending from about eighty nanometers (80 nm) to about one hundred nanometers (100 nm); and particles of aluminum;

wherein the first plurality of diamond particles constitutes between about fifty weight percent (50 wt %) and about ninety weight percent (90 wt %) of the mixture, the second plurality of diamond particles constitutes between about ten weight percent (10 wt %) and about fifty weight percent (50 wt %) of the mixture, and the particles of aluminum constitute between about one weight percent (1 wt %) and about five weight percent (5.0 wt %) of the mixture;

positioning the mixture adjacent a substrate; and subjecting the mixture and the substrate to a high pressure, high temperature (HPHT) sintering process to form a polycrystalline diamond compact on the substrate:

wherein an atomic concentration of the aluminum in the polycrystalline diamond compact decreases from an exposed working surface of the polycrystalline diamond compact in a direction extending toward an interface between the polycrystalline diamond compact and the substrate.

15. The method of claim 14, wherein subjecting the mixture and the substrate to an HPHT sintering process comprises subjecting the mixture and the substrate to a pressure of between about 7.5 GPa and about 8.0 GPa, and subjecting the mixture and the substrate to a temperature of between 1550° C. and about 1650° C.

16. The method of claim 14, wherein the first plurality of diamond particles and the second plurality of diamond particles comprise fluorinated diamond particles.

17. The method of claim 14, further comprising forming an intermetallic compound in interstitial spaces between the diamond particles of the first plurality of diamond particles and the second plurality of diamond particles.

18. The method of claim 17, wherein the intermetallic compound comprises cobalt and aluminum.

19. The method of claim 14, wherein the method does not comprise leaching the polycrystalline diamond compact so as to form voids in interstitial spaces between the first plurality of diamond particles and the second plurality of diamond particles.

* * * * *